US005115717A

United States Patent [19]

Roemer

[11] Patent Number: 5,115,717

[45] Date of Patent: May 26, 1992

[54] RAMMING APPARATUS

[76] Inventor: Helmuth Roemer, Attendorner Str. 135, D-5950 Finnentrop-Heggen, Fed. Rep. of Germany

[21] Appl. No.: 648,789

[22] Filed: Feb. 1, 1991

[30] Foreign Application Priority Data

Feb. 3, 1990 [DE] Fed. Rep. of Germany ..... 4003189

[51] Int. Cl.[5] ..... F15B 13/02

[52] U.S. Cl. ..... 91/49; 91/50; 91/234; 91/325; 173/91

[58] Field of Search ..... 91/232, 233, 234, 321, 91/235, 325, 47, 49, 50, 44; 173/91

[56] References Cited

U.S. PATENT DOCUMENTS

| | | | |
|---|---|---|---|
| 1,929,197 | 10/1933 | Bridgham | 91/234 |
| 3,057,331 | 10/1962 | Frantz | 91/235 |
| 4,070,948 | 1/1978 | Tkach et al. | 91/234 |
| 4,114,700 | 9/1978 | Tkach et al. | 175/19 |
| 4,194,435 | 3/1980 | Gaun et al. | 91/234 |
| 4,480,525 | 11/1984 | Jenne | 91/25 |
| 4,886,128 | 12/1989 | Roemer | 173/91 |

FOREIGN PATENT DOCUMENTS

| | | |
|---|---|---|
| 2428788 | 5/1977 | Fed. Rep. of Germany . |
| 2825732 | 12/1979 | Fed. Rep. of Germany . |
| 3104547 | 11/1982 | Fed. Rep. of Germany . |
| 2709312 | 2/1983 | Fed. Rep. of Germany . |
| 8700076.8 | 4/1987 | Fed. Rep. of Germany . |

*Primary Examiner*—Thomas E. Denion
*Attorney, Agent, or Firm*—Foley & Lardner

[57] ABSTRACT

A ramming apparatus having a shortened length without sacrificing ramming power requirements is disclosed comprising a housing having a front end and a rear end, a pneumatically driven percussion piston having a front end and a rear end operatively mounted in the housing for oscillating movement between the front end and the rear end of the housing, a front pressure chamber provided in the front end of the housing, a rear pressure chamber provided in the rear end of the housing, a high pressure air supply line, a control device for controlling the application of pneumatic pressure on the percussion piston, the control device having a control piston extending axially from the rear end of the percussion piston into an opening of an end piece of the housing and having at least one radial control channel that is closable by the end piece, and an axial channel provided in the percussion piston, wherein when the percussion piston is in a forward position the axial channel communicates with the radial control channel and the radial control channel communicates with the high pressure air supply line, and when the percussion piston is in a rear position the front pressure chamber communicates with the axial channel, the axial channel communicates with the radial channel, the radial channel communicates with the exterior beyond the end piece and the rear pressure chamber communicates with the high pressure air line.

9 Claims, 3 Drawing Sheets

RAMMING APPARATUS

BACKGROUND OF THE INVENTION

1. Field of the Invention

The present invention relates generally to a ramming apparatus and, more particularly, relates to a ramming apparatus having a pneumatically driven percussion piston for driving bore holes in the ground to place, for example, underground cables or wires and lines in the ground.

2. Description of the Prior Art

In conventional ramming apparatus having percussion pistons, as described in German Utility Model 8,700,076, a control device is usually formed by a tubular continuation that extends from the rear end of the percussion piston and a control sleeve that reaches inside the tubular continuation and is supported by an axially running bearing part on an end piece of the piston housing. The control sleeve and the percussion piston with the tubular continuation form a rear pressure chamber that is connected to a source of compressed air by a supply channel formed in the bearing part supporting the control sleeve. The buildup of pneumatic pressure in the rear pressure chamber brings about the forward movement of the percussion piston. When the percussion piston reaches the end of its forward movement and transfers the percussion energy to the housing, radial channels of the tubular continuation of the percussion piston are released by the front edge of the control sleeve, and the compressed air is channeled through these radial channels and through axial channels that are formed in the percussion piston and into a front pressure chamber. The rearward movement of the percussion piston is initiated with the channeling of the compressed air to the front pressure chamber taking advantage of the fact that the effective surface area of the piston in the front pressure chamber is greater than the effective surface area of the piston in the rear pressure chamber. During the rearward movement of the percussion piston, the radial channels of the tubular continuation are temporarily blocked by the control sleeve until the radial channels reach the rear edge of the control sleeve. At this point, the pressure in the front pressure chamber is relieved by the escape of the compressed air through the radial channels as well as the venting channels formed in the end piece of the housing, and a new percussion cycle is initiated.

In these types of prior art ramming apparatus, a reverse drive can be achieved by adjusting the control sleeve with the aid of a high pressure air hose that is connected to the apparatus in a manner such that compressed air is admitted earlier to the front chamber. As a result, the forward movement of the percussion piston is cushioned, and when the percussion piston reaches the end of its rearward movement, it strikes the end piece, and a rearwardly directed impetus is transferred to the housing.

According to German Utility Model 8,700,076, the control sleeve may be adjusted axially using a spindle drive driven by a source of pressurized or compressed air as supplied by a high pressure air hose or compressed air hose. Other apparatus are also known in which the control sleeve may be axially adjusted by pulling or pushing the air hose, with the machine switched off, or in which the control sleeve is provided with clearances that can be brought into a position corresponding to the radial channels of the tubular continuation by turning the control sleeve using a compressed air hose (German Patent Specification 3,104,547).

Of the various types of prior art apparatus, a common characteristic can be drawn between them relating to three sections lying one behind the other in the longitudinal direction: the main section of the percussion piston, a control section, formed by the tubular continuation of the percussion piston, the control sleeve and the bearing part, and finally the end piece of the housing. The main section of the percussion piston must have a certain length in order for an adequate inert mass of the percussion piston to be achieved. The length of the control section is determined by the stroke path of the percussion piston and, if appropriate, by the axial adjusting path of the control sleeve. The end piece of the housing serves for fastening the bearing part and the control sleeve and must be able to withstand the impact of the percussion piston during driving of the apparatus in the rearward direction; however, it nevertheless is weakened by the axial venting channels. Therefore, for reasons of stability, this end piece must likewise have a certain length. For these reasons, conventional apparatuses have a relatively large overall length.

SUMMARY OF THE INVENTION

The present invention overcomes the problems and disadvantages of the prior art by providing a ramming apparatus that has a shorter overall length than conventional ramming apparatus given a specific mass requirement for the percussion piston. Accordingly, the present invention is based on the object of providing a ramming apparatus that has a significantly shorter overall length when compared to conventional ramming apparatus, given a specific mass requirement for the percussion piston. The present invention provides a ramming apparatus that has the advantages of a shorter overall length including the benefit of increased efficiency of operation, increased efficiency in space usage, and easier handling without sacrificing the mass requirements for an effective percussion piston.

Additional objects and advantages of the invention will be set forth, in part, in the description which follows and, in part, will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and described herein, the ramming apparatus of the present invention comprises a housing having a front end and a rear end, a pneumatically driven percussion piston having a front end and a rear end operatively mounted in the housing for oscillating movement between the front end and the rear end o the housing, a front pressure chamber provided in the front end of the housing, a rear pressure chamber provided in the rear end of the housing, a high pressure air supply line, a control device for controlling the application of pneumatic pressure on the percussion piston, the control device having a control piston extending axially from the rear end of the percussion piston into an opening of an end piece of the housing and having at least one radial control channel that is closable by the end piece, and an axial channel provided in the percussion piston, wherein when the percussion piston is in a forward position the axial channel communicates with the radial control channel and the radial control channel communicates with the high pressure air supply line, and when the percussion piston is in a rear position the front pressure chamber communicates with the axial channel, the axial channel communicates with the radial channel, the radial channel communicates with the exterior beyond the end piece and the rear pressure chamber communicates with the high pressure air line.

In the ramming apparatus of the present invention, the control portion on the housing is formed by the end piece of the housing, and the control part which is able to move with the percussion piston is formed by a control piston which projects axially from the percussion piston and enters into an opening of the end piece. With this design, the end piece is consequently drawn-in within the housing such that, in comparison with the prior art, a reduction in the overall length of the ramming apparatus is achieved when the mass of the percussion piston is kept constant or a percussion piston having a greater mass is possible when the overall length of the ramming apparatus is kept constant.

The rear pressure chamber formed between the percussion piston and the end piece is preferably connected directly to the high pneumatic pressure source, and the supply of high pneumatic pressure and the venting of the front pressure chamber is controlled by radial control channels that are arranged radially in the control piston and that are connected by an axial channel in the percussion piston to the front pressure chamber. When the percussion piston is in the forward end position, the radial control channels are open to the rear pressure chamber. When the percussion piston is in the rear end position, the radial control channels are open to the exterior atmosphere past the end piece of the housing.

In order to permit a reversal of the driving direction, in the case of the apparatus according to the invention the end piece is provided with a branch line, via which the control channels of the control piston can already within the end piece be connected to the pressure source. Via this branch line, compressed air can already be introduced into the front pressure chamber before the percussion piston reaches its forward end position. In this way, the forward movement of the percussion piston is damped. When, during the subsequent rearward movement of the percussion piston, the control channels of the control piston run through the end piece, the front pressure chamber receives an additional surge of pressure via the branch line, so that the rearward stroke of the piston is extended.

The compressed air supply to the rear pressure chamber preferably takes place via an axial bore which is formed in the end piece and receives the end of the compressed air hose and from which the branch line branches off in such a way that the mouth of the branch line can be opened and closed by displacing or turning the compressed air hose.

It is to be understood that both the foregoing general description and the following detailed description are exemplary and explanatory only and are not restrictive of the invention as claimed.

The accompanying drawings, which are incorporated in and constitute a part of this specification, illustrate two embodiments of the invention and together with the description serve to explain the principles of the invention.

DETAILED DESCRIPTION OF THE PREFERRED EMBODIMENTS

Reference will now be made in detail to the present preferred embodiments of the present invention, examples of which are illustrated in the accompanying drawings. Wherever possible, the same reference numbers will be used throughout the drawings to refer to the same or like parts.

Figure 1:
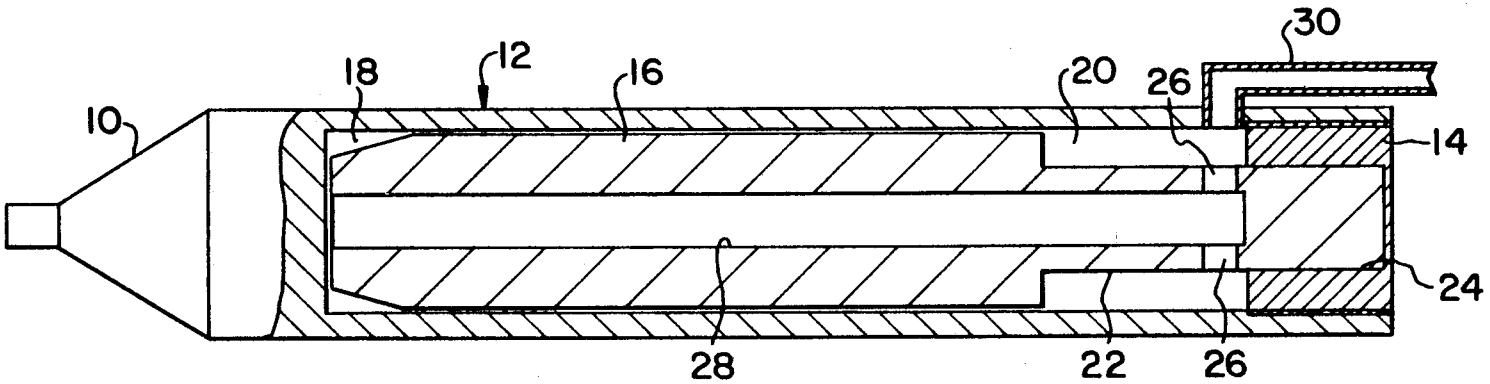
FIG. 1 is a sectional view of a ramming apparatus of the present invention with the percussion piston in the forward end position.
Figure 2:
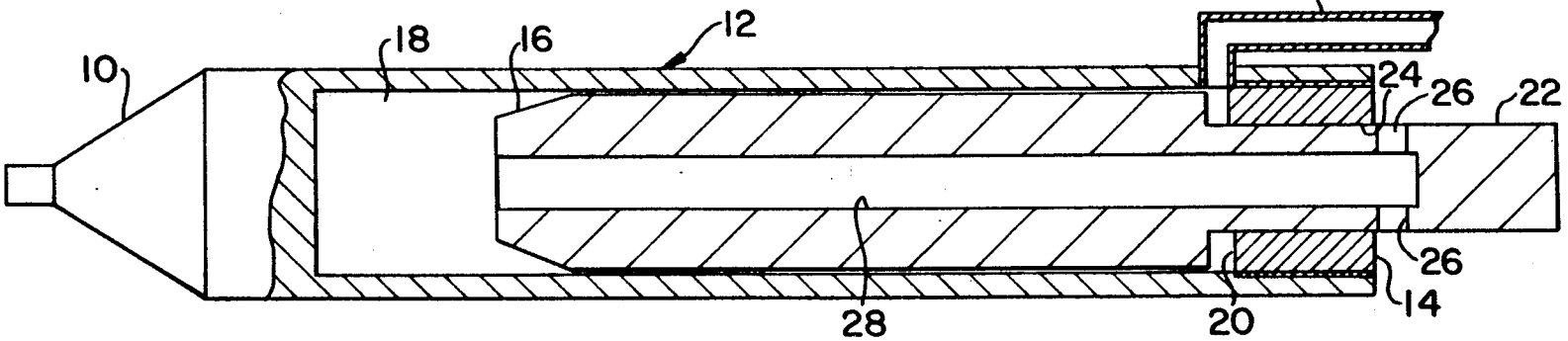
FIG. 2 is a sectional view of the ramming apparatus shown in FIG. 1 with the percussion piston in the rear end position.

Referring to FIGS. 1 and 2, a first embodiment of the ramming apparatus according to the present invention is shown having a housing 12, which is provided with a percussion tip 10 and is closed off at the rear end by an end piece 14. Inside the housing 12, a front pressure chamber 18 and a rear pressure chamber 20 are formed by a percussion piston 16, operatively guided axially and movably in the housing. The percussion piston 16 is provided at the rear end with an axially projecting control piston 22, that enters an opening 24 of the end piece 14 and is guided slidingly in this opening. The control piston has radial control channels 26, that are connected via an axial channel 28 to the front pressure chamber 18. A high pressure or compressed air hose 30 is connected to the rear pressure chamber 20.

When the percussion piston 16 is in the forward end position as shown in FIG. 1, the front pressure chamber 18 is supplied with compressed air via the compressed air hose 30, the rear pressure chamber 20, the radial control channels 26 and the axial channel 28. The pressure in the front pressure chamber 18 acts on the entire cross-sectional area of the percussion piston 16, while the pressure prevailing in the rear chamber 20 only acts on the annular area outside the control piston 22. The percussion piston 16 is therefore moved in the rearward direction. When the control channels 26 enter the end piece 14, the compressed air supply for the front pressure chamber 18 is interrupted. Due to mass inertia, however, the percussion piston 16 continues to move back until it reaches the rear end position shown in FIG. 2. In this position, the control channels 26 outside the end piece 14 are connected to the exterior atmosphere such that the front pressure chamber 18 is vented. The rearward movement of the percussion piston 16 is braked and then driven in the forward direction by the pressure still prevailing in the rear pressure chamber 20. The forward movement of the percussion piston 16 is accelerated so that it strikes the front end of the housing 12 at high speed and transfers a driving impetus to the housing. This sequence of operations described above are repeated so that the ramming apparatus is driven through the earth.

Because the compressed air hose 30 is connected at the side, the ramming apparatus shown in FIGS. 1 and 2 is preferably only used as a percussion machine on open surfaces. FIGS. 3 to 6 show a ramming apparatus that has been modified to be suitable for use beneath the earth surface and has a compressed air hose 30 that enters the housing axially from the rear. In the modified apparatus, a reverse direction driving capability by remote control is desirable.

In the modified embodiment of the apparatus of the present invention shown in FIGS. 3 to 6, the compressed air hose 30 is held rotatably in an axial bore 32 of the end piece 14. The axial bore 32 is connected via a radial bore 34 to an annular chamber 36, that surrounds the circumference of the control piston 22. The compressed air hose 30 is provided with a lateral opening 38, which is in the same axial position as the radial bore 34. In the position shown in FIGS. 3 to 5, the lateral opening 38 of the compressed air hose faces away from the radial bore 34, and the compressed air passes exclusively into the rear pressure chamber 20. In this position, the ramming apparatus is driven in the forward direction, as described above in conjunction with FIGS. 1 and 2.

Figure 6:
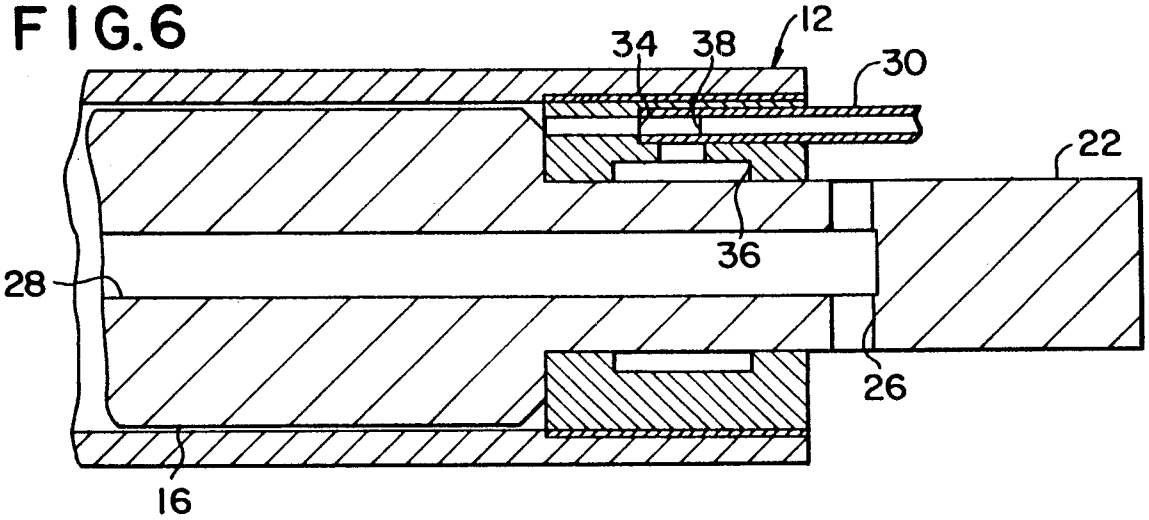
FIG. 6 is an enlarged partial, section view showing the control device of the ramming device shown in FIGS. 3 and 4 when the percussion piston is in the rear end position.

If, however, the compressed air hose 30 is turned into the position shown in FIG. 6, the lateral opening 38 of the compressed air hose is aligned with the radial bore 34 of the end piece, and the opening 38, the radial bore 34 and the annular chamber 36 form a branch line, by which the front pressure chamber 18 can be supplied with compressed air, while the control channels 26 pass the end piece.

Figure 3:
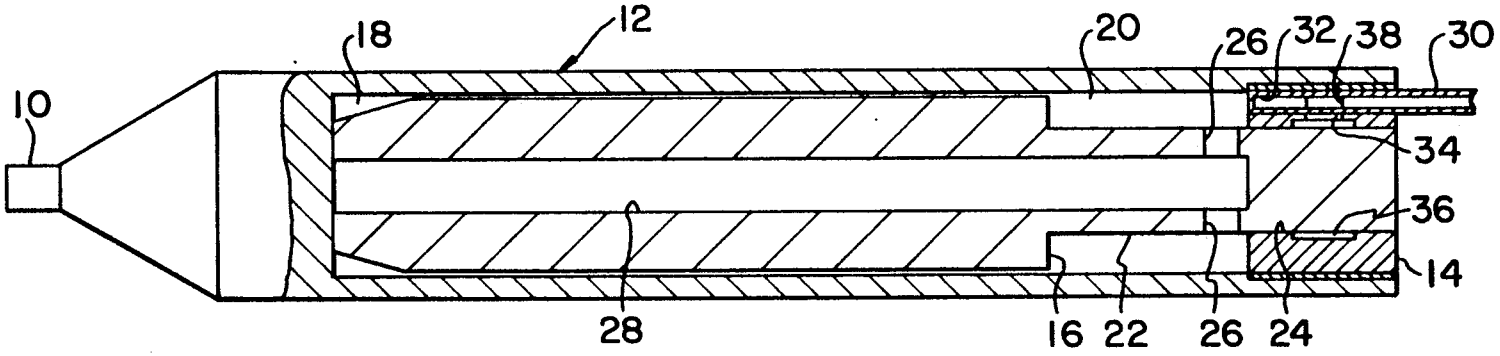
FIG. 3 is a sectional view of an alternate embodiment of the ramming apparatus of the present invention with the percussion piston in the forward position.
Figure 4:
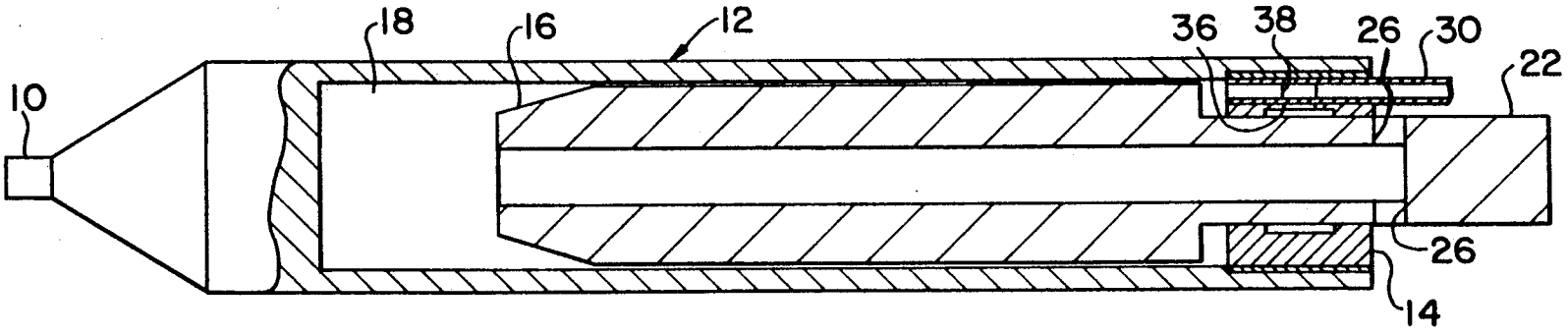
FIG. 4 is a sectional view of the ramming apparatus shown in FIG. 3 with the percussion piston in the rear end position.
Figure 5:
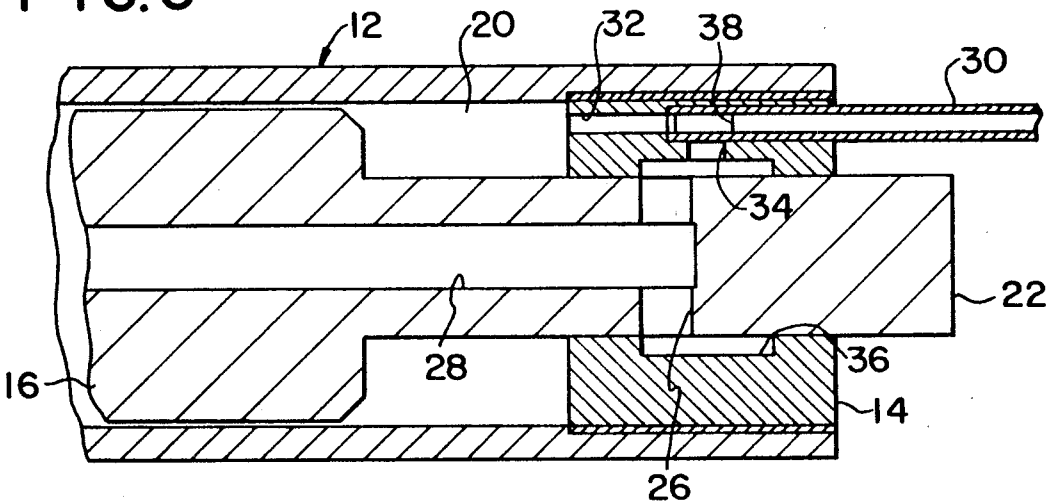
FIG. 5 is an enlarged partial, sectional view showing the control device of the ramming apparatus shown in FIGS. 3 and 4 when the percussion piston is traveling in a forward direction.

When the compressed air hose 30 is in the position shown in FIG. 6 and the percussion piston 16 moves rearward out of the position shown in FIG. 3, the connection between the compressed air source and the front pressure chamber 18 is temporarily interrupted when the control channels 26 enter the end piece 14. When the percussion piston reaches the position shown in FIG. 5, however, this connection is re-established by the branch lines 38, 34, 36. Consequently, a high pressure is built up once again in the front pressure chamber 18, while the control channels 26 run through the annular chamber 36. The percussion piston is therefore accelerated rearward more powerfully. Although the front pressure chamber 18 is vented, when the control channels 26 move beyond the end piece 14 to the rear, the speed and momentum of the percussion piston is then so great that it can no longer be braked but strikes against the end piece 14, as is shown in FIG. 6. In this manner, an impetus in the rearward direction is transferred to the housing12, so that the ramming apparatus is driven rearward.

During the subsequent forward stroke of the percussion piston, the front pressure chamber18 is again supplied with compressed air as soon as the control channels 26 re-enters the annular chamber 36. The forward movement of the percussion piston is thereby braked and then reversed so that the percussion piston does not strike against the front end of the housing 12.

The length of the annular chamber 36 in the axial direction is chosen such that a braking and reversal in the movement of the percussion piston 16 can be achieved over this length. Nevertheless, even if the percussion piston should shoot out forward beyond the intended reversing position, so that the control channels 26 are separated from the annular chamber 36, no functional disruption occurs, because the air volume of the front pressure chamber 18 is compressed such that the percussion piston rebounds resiliently.

In the case of the apparatus shown in FIGS. 3 to 6, due to the operating principle described above, the driving direction can be reversed in a simple way by the compressed air hose 30 being turned about its longitudinal axis. However, as an alternative, the movement reversal can also be brought about by the compressed air hose 30 being displaced in the axial direction or displaced and turned at the same time. An anti-withdraw means (not shown) prevents the compressed air hose 30 from being withdrawn completely from the end piece 14.

In an alternate embodiment, the movement reversal can also be brought about by use of a valve which is arranged in the end piece 14 and is operated by a cable pull or other remote-control means or which automatically switches over when the pressure supply is switched off.

In the case of the illustrative embodiments described, the end piece 14 is arranged directly at the end of the housing case so that, in its rearward end position, the control piston 22 protrudes freely out of the housing. If need be, however, the housing 12 may also be extended to the rear beyond the end piece 14, or further housing parts may be added to the rear to the end piece 14. Thus, it is possible for example to add on a component with a screen or a protective device to prevent dirt from being able to penetrate into the body of the machine. To this extent, the term "end piece" is to be understood for the purposes of the present application as a component which is at the end of one of the pressure chambers, but not necessarily at the end of the housing.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A ramming apparatus comprising:

a pneumatically driven percussion piston having a front end and a rear end operatively mounted in a housing for back and forth movement along the axis of the piston between a front end and a rear end of the housing;

a compressed air hose;

a front pressure chamber provided in the front end of the housing;

a rear pressure chamber provided in the rear end of the housing, the rear pressure chamber being constantly connected to the compressed air hose;

a control device for controlling the application of pneumatic pressure on the percussion piston having a control piston extending axially from the rear end of the percussion piston into a continuous opening of an end piece of the housing and having at least one radial control channel that can be closed by the end piece; and an axial channel provided along the axis of the percussion piston to supply pneumatic pressure to the front pressure chamber, wherein the end piece has a branch line that connects the compressed air hose to the control channel of the control piston when the percussion piston is in a position at a distance from its forward end position, and a switching device for opening and closing the branch line, wherein the axial channel is in connection with the radial control channel, the radial control channel connects the axial channel to the compressed air hose, and wherein in the rearward end position of the percussion piston, the front pressure chamber is vented by the axial channel and the radial control channel.

2. The ramming apparatus as claimed in claim 1, wherein the radial control channel is formed in a longitudinal section of the control piston, which section protrudes from the end piece when the percussion piston is in the rearward end position.

3. The ramming apparatus as claimed in claim 1, wherein the rear pressure chamber is connected by an axial bore of the end piece to the compressed air hose.

4. The ramming apparatus as claimed in claim 1, wherein the compressed air hose is turned and displaced in an axial bore and wherein the switching device and part of the branch line are formed by a lateral opening of the compressed air hose and a radial bore of the end piece, opening out into the axial bore.

5. The ramming apparatus as claimed in claim 1, wherein the branch line has an annular chamber surrounding the control piston and extending in the longitudinal direction of the end piece.

6. A ramming apparatus comprising:

a housing having a front end and a rear end;

a pneumatically driven percussion piston having a front end and a rear end operatively mounted in the housing for oscillating movement between the front end and the rear end of the housing;

a front pressure chamber provided in the front end of the housing;

a rear pressure chamber provided in the rear end of the housing;

a compressed air hose constantly connected to the rear pressure chamber;

a control device for controlling the application of pneumatic pressure on the percussion piston;

the control device having a control piston extending axially from the rear end of the percussion piston into an opening of an end piece of the housing and having at least one radial control channel that is closable by the end piece; and an axial channel provided in the percussion piston, wherein the end piece has a branch line that connects the compressed air hose to the control channel of the control piston when the percussion piston is in a position at a distance from its forward end position, and a switching device for opening and closing the branch line, wherein when the percussion piston is in a forward position the axial channel communicates with the radial control channel and the radial control channel communicates with the compressed air hose, and wherein when the percussion piston is in a rear position the front pressure chamber communicates with the axial channel, the axial channel communicates with the radial channel, the radial channel communicates with the exterior beyond the end piece and the rear pressure chamber communicates with the compressed air hose.

7. The ramming apparatus as claimed in claim 9, wherein the compressed air hose is displaced in an axial bore and wherein the switching device and part of the branch line are formed by a lateral opening of the compressed air hose and a radial bore of the end piece, opening out into the axial bore.

8. The ramming apparatus as claimed in claim 9, wherein the branch line has an annular chamber surrounding the control piston and extending in the longitudinal direction of the end piece.

9. The ramming apparatus as claimed in claim 7, wherein the axial bore is connected by the radial bore to a chamber that surrounds a circumference of the control piston when the percussion piston is in a position at a distance from its forward end position.

* * * * *